US011597582B1

(12) United States Patent
French

(10) Patent No.: US 11,597,582 B1
(45) Date of Patent: Mar. 7, 2023

(54) DOUBLE WALL INSULATED BEVERAGE HOUSING SYSTEM WITH TEMPERATURE MAINTENANCE

(71) Applicant: Marcus French, Bentonville, AR (US)

(72) Inventor: Marcus French, Bentonville, AR (US)

(73) Assignee: MERCHANTS FIRST, LLC, Rogers, AR (US)

( * ) Notice: Subject to any disclaimer, the term of this patent is extended or adjusted under 35 U.S.C. 154(b) by 42 days.

(21) Appl. No.: 16/508,065

(22) Filed: Jul. 10, 2019

Related U.S. Application Data

(63) Continuation-in-part of application No. 62/695,960, filed on Jul. 10, 2018.

(51) Int. Cl.
*B65D 81/38* (2006.01)
*F25D 31/00* (2006.01)

(52) U.S. Cl.
CPC ..... *B65D 81/3886* (2013.01); *F25D 31/007* (2013.01); *F25D 2303/0843* (2013.01); *F25D 2331/809* (2013.01)

(58) Field of Classification Search
CPC ..... F25D 31/007; F25D 2303/083; F25D 2303/0831; F25D 2303/0841; F25D 2331/805; B65D 81/3809; B65D 81/3883; B65D 81/3881; B65D 81/3886
See application file for complete search history.

(56) References Cited

U.S. PATENT DOCUMENTS 3,205,677 A * 9/1965 Stoner ..... F25D 3/08 62/457.3
5,361,604 A * 11/1994 Pier ..... F25D 31/007 62/530
6,367,652 B1 * 4/2002 Toida ..... B65D 25/2811 220/592.16
8,534,345 B1 * 9/2013 French ..... A47J 41/00 165/10
9,555,949 B1 * 1/2017 French ..... A47J 41/00
9,915,472 B2 * 3/2018 Sabo ..... F25D 31/007
2006/0156756 A1 * 7/2006 Becke ..... A47G 19/2288 62/457.3
2009/0266737 A1 * 10/2009 Cole ..... A47G 19/2272 206/499
2015/0053679 A1 * 2/2015 Liu ..... B65D 81/3881 220/215
2017/0071381 A1 * 3/2017 Ze ..... B65D 81/3844

* cited by examiner

*Primary Examiner* — Ana M Vazquez
(74) *Attorney, Agent, or Firm* — Schrantz Law Firm, PLLC; Stephen D. Schrantz

(57) ABSTRACT

The double walled vacuum insulated beverage housing system provides an aperture for receiving a heat transfer unit. The heat transfer unit also provides an aperture for receiving a beverage vessel within the heat transfer unit. The heat transfer unit stores a heat transfer material including but not limited to a fluid, gel, phase change material, or other substance that can be heated or cooled depending upon the desired effect on the beverage. A retention shoulder secures the heat transfer unit adjacent an insulating chamber to insulate both the heat transfer unit and the beverage.

19 Claims, 9 Drawing Sheets

DOUBLE WALL INSULATED BEVERAGE HOUSING SYSTEM WITH TEMPERATURE MAINTENANCE

CROSS-REFERENCE TO RELATED APPLICATIONS

This application claims priority to and is a continuation in part of U.S. Patent Application No. 62/695,960 entitled "DOUBLE WALL INSULATED BEVERAGE CONTAINER WITH TEMPERATURE MAINTENANCE" filed on Jul. 10, 2018, which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The invention relates to a beverage housing system, and, more particularly, to a beverage housing system having a double walled housing and a removable heat transfer unit disposed within the housing for cooling and/or heating a beverage within the housing. Users can then remove and/or replace the heat transfer unit. People use insulated beverage holders to provide insulation to a beverage in order to maintain the temperature of the beverage.

Placing the beverage within a double walled insulated beverage housing insulates the beverage from the environment during consumption of the beverage. One type of insulated beverage holder is constructed from suitable foam configured to receive a beverage can. The foam insulation assists in maintaining the desired condition of the beverage.

Certain problems exist with the some of the aforesaid prior art beverage containers. The beverage must initially be cooled or heated to the desired temperature. Once the beverage vessel is removed from its chilled environment, the beverage will adjust to the temperature of the environment. The insulated beverage container slows this result. It is an object of the present invention to provide a beverage holder that maintains a proper environment for sustaining the desired temperature of the beverage to allow a user to consume a beverage at the desired temperature over an extended period of time.

II. Description of the Known Art

Patents and patent applications disclosing information relevant to beverage systems are disclosed below. These patents and patent applications are hereby expressly incorporated by reference in their entirety.

U.S. Pat. No. 4,183,226 issued to Moore on Jan. 15, 1980 ("the '226 patent") teaches a means for chilling and insulating a canned or bottled beverage such as beer including a cylindrical sleeve of reusable refrigerant disposed within an insulative beverage can holder and displacing the annular "dead air" cavity between a beverage can situated therein and the side walls of the holder. The lining 24 taught by the '226 patent is formed of thin walled material such as plastic and may be slidably removable from the holder 10.

U.S. Pat. No. 4,782,670 issued to Long on Nov. 8, 1988 ("the '670 patent") teaches an insulated beverage container having both hot and cold retention capabilities designed for the purpose of maintaining, increasing, or decreasing the temperature of the contents in the container. The plastic structure of the container taught by the '670 patent, an insulating sleeve between duel walls of the container, and encapsulated between the dual walls, a thermoplastic gel capable of retaining heat as well as cold, produces a multi-action container which can be heated in a microwave oven, a conventional oven, or can be frozen in a freezer.

U.S. Pat. No. 5,419,154 issued to Christoff on May 30, 1995 ("the '154 patent") teaches a beverage container provided for use with a golf cart or the like having a support member. The container taught by the '154 patent includes a body having a central beverage receiving cavity which extends from the closed bottom of the body to the open top end of the body. The container taught by the '154 patent also includes means for receiving a freezable gel, the means being disposed within the beverage receiving cavity. The '154 patent also teaches a cap that is provided to be releasably attached to the open top end of the body.

The '154 patent teaches that inwardly from the bottom wall 20a is a cavity 122 which in the form of the invention illustrated in FIG. 10 of the drawings, extends across the bottom surface and up along the side walls of the container body 20. This cavity taught by the '154 patent is intended to be filled with a freezable gel 27. The '154 patent teaches that interposed between the walls of the cavity 122 and the exterior wall of the body 20 is an insulator wall 126 which, once the gel is frozen, will maintain that condition for a fixed period of time.

A hollow gel receiving chamber 128d is configured to be filled with a freezable gel. This gel filled insert may be placed in a freezer apart from the cap 125 and the body 20 to be frozen. After the insert 128 is frozen, it may be matingly threaded into the female boss 126 on the top cap 125. The body 20 is then filled with an appropriate beverage and the top cap installed as previously described.

U.S. Pat. No. 5,269,368 issued to Schneider on Dec. 14, 1993 ("the '368 patent") teaches a reusable cooling and insulating device for bottles and the like that is provided in the form of a jacket having a single or plurality of flexible compartments which are interconnected having an inner chamber and an outer chamber therein. The '368 patent teaches that a heating and cooling temperature conditionable liquid is housed in the inner chamber which enables the inner diameter of the jacket formed by the inner chamber to confirm with the surface of the object on the which the jacket is positioned for heating or cooling. A flexible insulator of air or air and flexible plastic taught by the '368 patent is positioned in the outer chamber of each compartment for directing a greater temperature transfer from liquid to the object and less heat exchange from the liquid to the environment.

U.S. Pat. No. 6,134,894 issued to Searle on Oct. 24, 2000 ("the '894 patent") teaches a container for a beverage that has a conventional external configuration with a cylindrical wall closed by a top member. The '894 patent teaches that the contents of the container can be cooled, heated, or kept hot, or kept cold by the insertion of an insert into the external cavity. To ensure good heat transfer, the insert taught by the '894 patent is push fitted into the external cavity. The insert taught by the '894 patent may be heated or cooled before it is inserted, or it may be actuable to heat up or to cool down.

The can 10 taught by the '894 patent with its contents, but without its insert 30, is stored in a refrigerator, and the insert 30 is kept in a freezer until the material 31 therein is frozen solid. When it is required to use the can 10, the '894 patent teaches that it is removed from the refrigerator and the frozen insert 30 is inserted in its cavity 20. The insulating cap 28 taught by the '894 patent is put in place.

U.S. Pat. No. 6,128,915 issued to Wagner on Oct. 10, 2000 ("the '915 patent") teaches a portable food and beverage cooling device that includes a flexible cooling pouch having outer and inner faces. A cooling pack taught by the '915 patent is provided in the cooling pouch. A flexible insulating panel taught by the '915 patent is provided in the cooling pouch. The '915 patent teaches that the insulating panel has a central region interposed between the outer face of the cooling pouch and the cooling pack. Before use, the invention taught by the '915 patent is stored in a freezer to allow the coolant cells to freeze and be ready for use at a moments notice.

U.S. Pat. No. 6,094,935 issued to Stein on Aug. 1, 2000 ("the '935 patent") teaches a drinking container having a removable, freezable member. The drinking container taught by the '935 patent has a cylindrical inner receptacle and a surrounding cylindrical outer receptacle. The '935 patent teaches an annular chamber that is formed between the inner and outer receptacles. A refrigerant member taught by the '935 patent comprising a plastic envelope containing a freezable gel is dimensioned to fit into the annular chamber, and is readily removable therefrom. A cap taught by the '935 patent engages the drinking container to retain the refrigerant member once placed in the annular chamber. The '935 patent teaches that the refrigerant member is preferably an annular sleeve which slips between the inner and outer receptacles, and folds flat for storage and freezing. The '935 patent teaches that the drinking receptacle includes a removable cap which closes only the open chamber which receives the refrigerant member. The cap taught by the '935 patent both retains the refrigerant member, assists in insulating the same, and excludes condensate from the refrigerant chamber.

U.S. Pat. No. 5,361,604 issued to Pier on Nov. 8, 1994 ("the '604 patent") teaches a portable and hand-held beverage chilling device, having water utilized as a coolant that can be frozen between non-permanently sealed walls of the device, that is intended for chilling and subsequent maintenance of a canned or bottled beverage at its coldest liquid state, while providing direct consumption from its container. The beverage cooler taught by the '604 patent features two cylindrical receptacles that are enclosed on one end. These receptacles, called shells, taught by the '604 patent are of different diameter and height such that the inner is placed within the outer and a coolant is contained in the spacial void created.

U.S. Pat. No. 4,793,149 issued to Riche on Dec. 27, 1988 ("the '149 patent") teaches a cooling and insulating holder for a container such as a beverage can or the like that has a plurality of hollow arcuate reservoir pieces which fit together to form a ring with a receiving opening therein to receive the container.

U.S. Pat. No. 4,399,668 issued to Williamson on Aug. 23, 1983 ("the '668 patent") teaches a flexible, multilayer thermal wrap for beverage containers. The wrap taught by the '668 patent has an inner coolant layer for wrapping about the container which conforms to the container's shape and leaves an opening at the container's top to expose the pouring end. The coolant layer taught by the '668 patent is externally surrounded by an insulative layer.

U.S. Pat. No. 8,534,345 issued to French et al. on Jan. 31, 2017 teaches an insulated beverage housing provides an aperture for receiving a heat transfer unit. The heat transfer unit taught by the '345 patent provides an aperture for receiving a container. The heat transfer unit stores a heat transfer material including but not limited to a fluid, gel, or other substance that can be heated or cooled depending upon the desired effect on the beverage. The removable heat transfer unit may be easily removed and/or installed from the housing to heat or cool the heat transfer material for use in affecting the temperature of the beverage.

The beverage holder of the present invention is especially configured for maintaining the desired condition of the beverage for an extended period of time. The present invention overcomes many of the disadvantages of known insulated beverage holders by providing vacuum sealed double wall insulation and a heat transfer unit stored within that cools or heats the beverage.

Therefore, the present invention is needed to improve the ability to heat or cool a beverage and to maintain the desired temperature of a beverage. The present invention is also needed to allow a user to replace the heat transfer unit with another heat transfer unit to continue to cool or heat the beverage as desired.

SUMMARY OF THE INVENTION

The present invention provides a housing having an aperture configured to receive a heat transfer unit. The heat transfer unit installs within the housing. The user may also remove and replace the heat transfer unit within the housing. In one embodiment of the present invention, the housing provides an inner and outer wall, the insulating chamber between the inner wall and the outer wall being vacuum sealed. The heat transfer unit inserts into an opening interior of the inner wall. Different embodiments of the present invention receive different containers, vessels, or serve as a vessel for various beverages. In one embodiment, the present invention receives a beverage container, such as a can, water bottle, or wine bottle. In another embodiment, the present invention serves as a beverage vessel, such as a container, cup, or bottle.

The heat transfer unit cools or heats the beverage depending upon the desired results. A beverage container or vessel inserts into the heat transfer unit. In one embodiment, the heat transfer unit is constructed from a rigid or semi-rigid material. The heat transfer unit of such an embodiment is rigid or semi-rigid prior to being frozen and remains rigid/semi-rigid. Such a rigid/semi-rigid heat transfer unit maintains its shape, such as a cylindrical shape or conical shape necessary to fit within the housing. Such a rigid/semi-rigid heat transfer unit also maintains its shape for receiving a beverage container/vessel.

Different embodiments of the present invention allow for different types of heat transfer. The heat transfer unit stores a fluid, gel, phase change material, or other substance that can be heated or cooled depending upon the desired effect on the beverage. In one embodiment, the present invention cools a beverage such that the heat transfer unit will have a coolant, such as water, a phase change material, a gel, or a chemical that will cause an endothermic reaction. In another embodiment, the present invention heats a beverage such that the heat transfer unit will have a heat supplying material, phase change material, or chemical that will cause an exothermic reaction.

It is an object of the present invention to alter the temperature of a beverage by either heating or cooling the beverage as desired by the user.

It is another object of the present invention to provide an insulated housing to maintain the temperature of a beverage and to provide an insulated layer between the user's hand and the beverage while the user is holding the beverage.

It is another object of the present invention to provide a double wall housing with vacuum insulation to maintain the temperature of a beverage and to provide an insulated layer between the user's hand and the beverage while the user is holding the beverage.

It is another object of the present invention to maintain the temperature of the heat transfer unit.

It is another object of the present invention to provide a heat transfer unit that maintains contact with a beverage container or vessel or is in close proximity of the beverage container or vessel to heat or cool the beverage.

It is another object of the present invention to provide a heat transfer unit that can be replaced with a different heat transfer unit to control the temperature of the beverage.

It is another object of the present invention to deter heat transfer to the environment.

It is another object of the present invention to provide a heat transfer unit that heats or cools to allow for a wide temperature range to be applied to the beverage.

It is another object of the present invention to provide a reusable heat transfer unit that can placed within a housing.

It is another object of the present invention to provide a heat transfer unit that may be removed from a housing to reduce the insulated effect of the housing when cooling or heating the heat transfer unit to reduce the time and energy required to change the temperature of the heat transfer unit.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
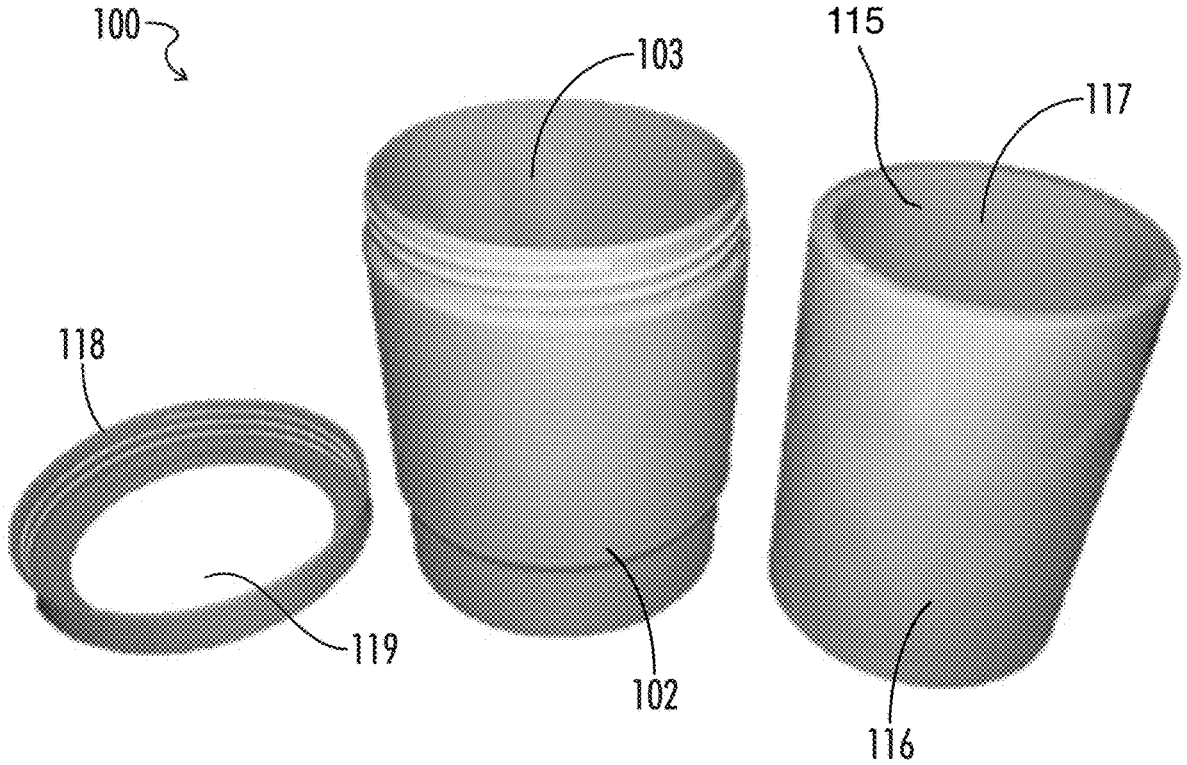
FIG. 1 is an environmental view of one embodiment of the present invention.

Referring to FIGS. 1 and 6-9, the present invention relates to a beverage housing system for holding a beverage generally shown as 100. FIG. 1 shows an environmental view of one embodiment of the present invention. Beverage housing system 100 allows the user to heat or cool a beverage of their choice. Housing 102 is a double walled vacuum insulated device capable of receiving a transfer housing 115, such as an insert, such as a heat transfer unit 116, that cools or heats a beverage.

Housing 102 accepts a heat transfer unit 116. The heat transfer unit 116 is constructed from a rigid or semi-rigid material, including but not limited to plastic, metal, rigid material, semi-rigid material. The heat transfer unit 116 maintains its shape for insertion into the housing 102. The heat transfer unit 116 also maintains its shape for receiving a container or vessel into the heat transfer unit 116.

The heat transfer unit 116 is available in different shapes, including but not limited to, cylindrical, conical, cylindrical with closed bottom, cylindrical having a partially closed bottom with a small opening in the bottom, cylindrical with a partially closed bottom having a finger sized opening centrally located in the bottom, cylindrical with open bottom, and conical with an open bottom. The heat transfer unit constructed from the rigid or semi-rigid material maintains its shape, such as the shapes identified above.

The cylindrical heat transfer unit 116 removably inserts into an aperture of the housing 102. The user inserts the heat transfer unit 116 within the housing. The heat transfer unit 116 releasably attaches for removal of the heat transfer unit 116 from the housing. The user may also replace a heat transfer unit 116 with a colder heat transfer unit if desired. A user may remove the heat transfer unit 116 to chill or heat the heat transfer unit 116 depending upon the desired function. Heat transfer unit 116 includes a substance capable of being heated or cooled to maintain specific conditions for an extended period of time.

In one embodiment, heat transfer unit 116 stores a phase change material. The heat transfer unit heats or cools the beverage. A heat transfer unit stores a fluid, gel, or other substance that can be heated or cooled depending upon the desired effect on the beverage. In other embodiment, the heat transfer unit may provide an endothermic reaction or exothermic reaction depending upon the desired results of the heat transfer unit.

Threaded lid 118 releasably attaches to housing 102 to maintain the heat transfer unit 116 within housing 102. Threaded lid 118 provides a beverage aperture 119 configured to receive a beverage or a beverage vessel. In one embodiment, the lid 118 extends radially outward from the aperture 119. The beverage vessel may be a container for holding a beverage, such as a can, bottle, cup, glass, or other type of receptacle capable of holding a beverage.

Figure 2:
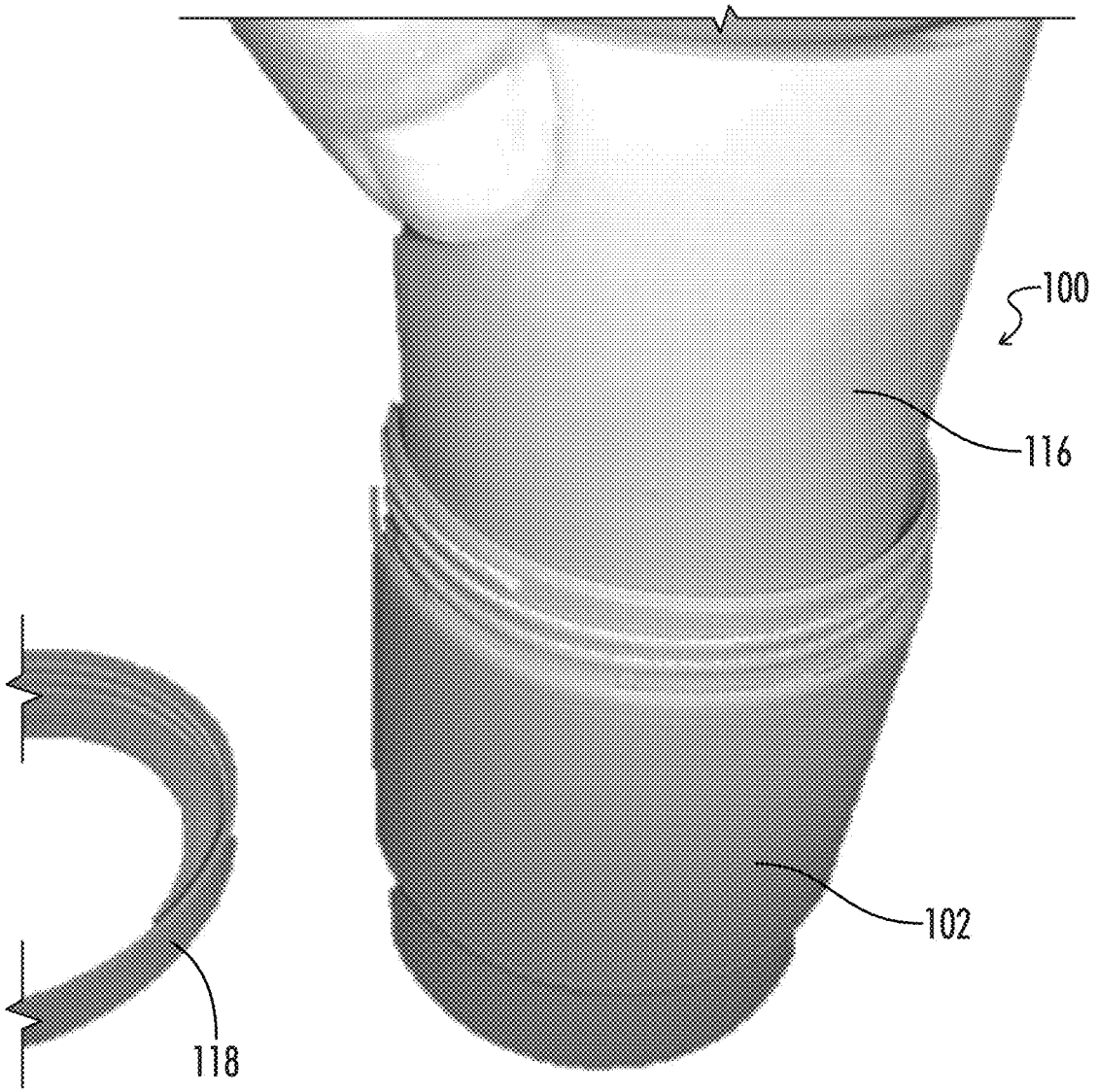
FIG. 2 is an environmental view thereof.
Figure 3:
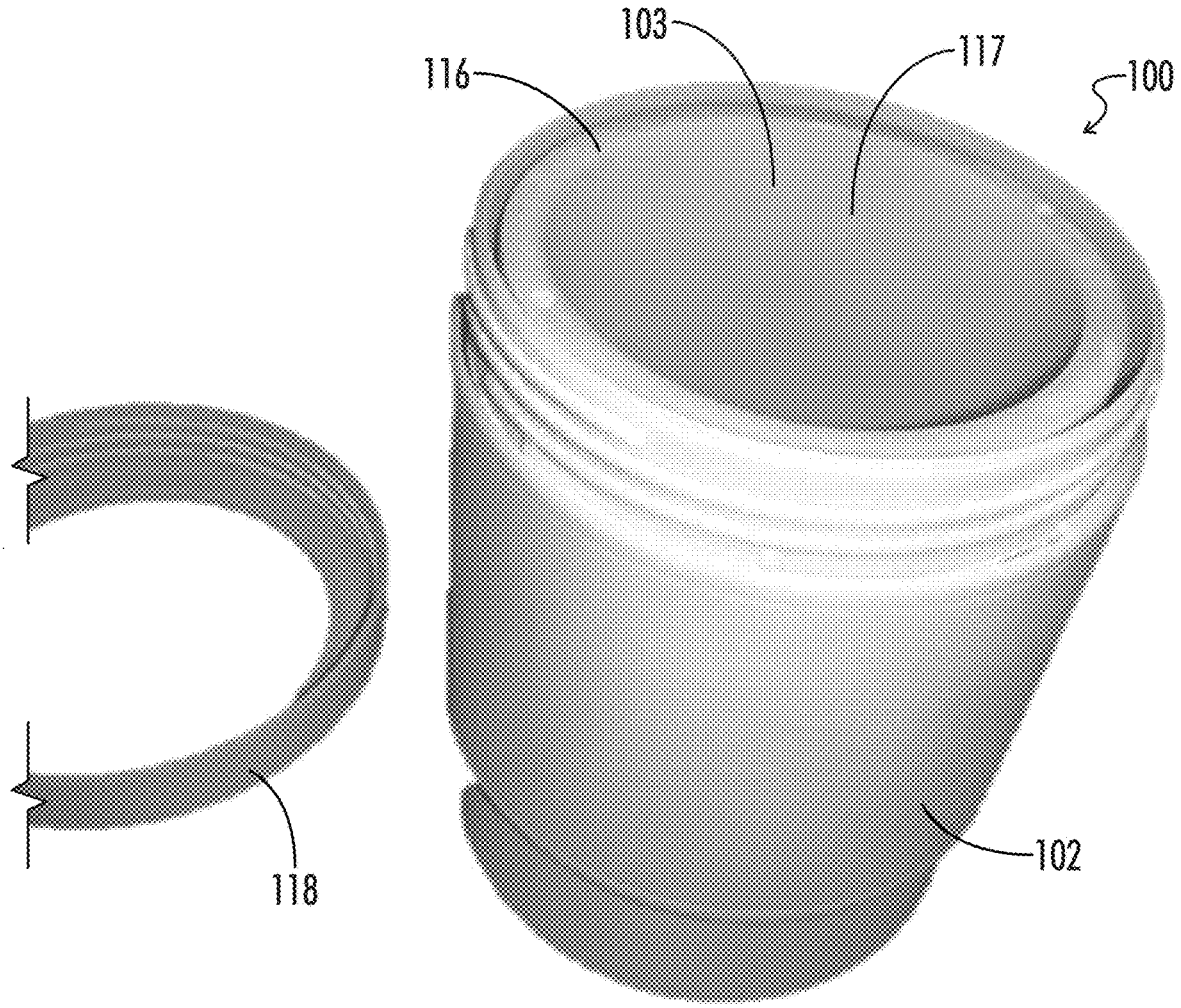
FIG. 3 is an environmental view thereof.
Figure 4:
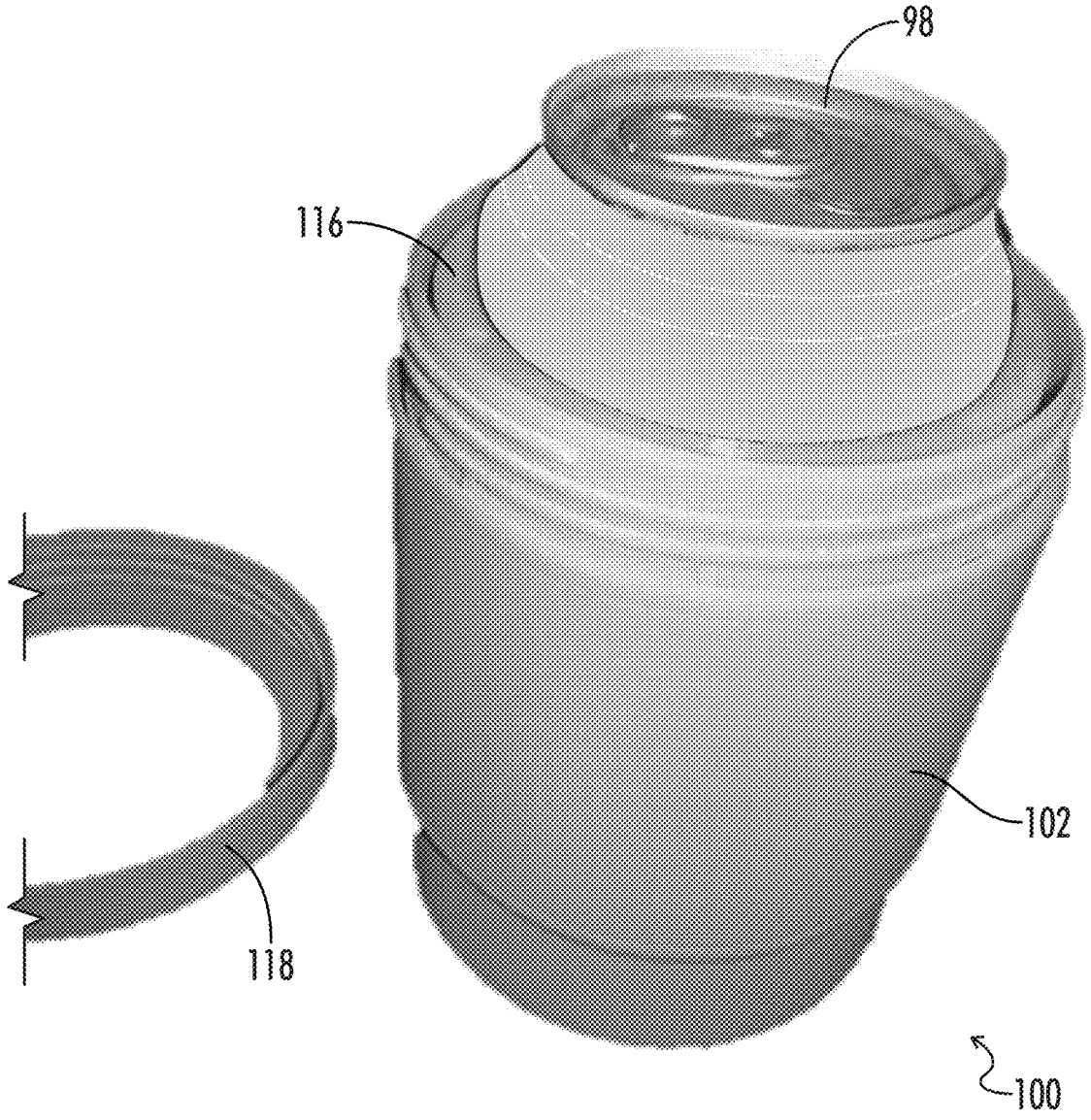
FIG. 4 is an environmental view thereof.
Figure 5:
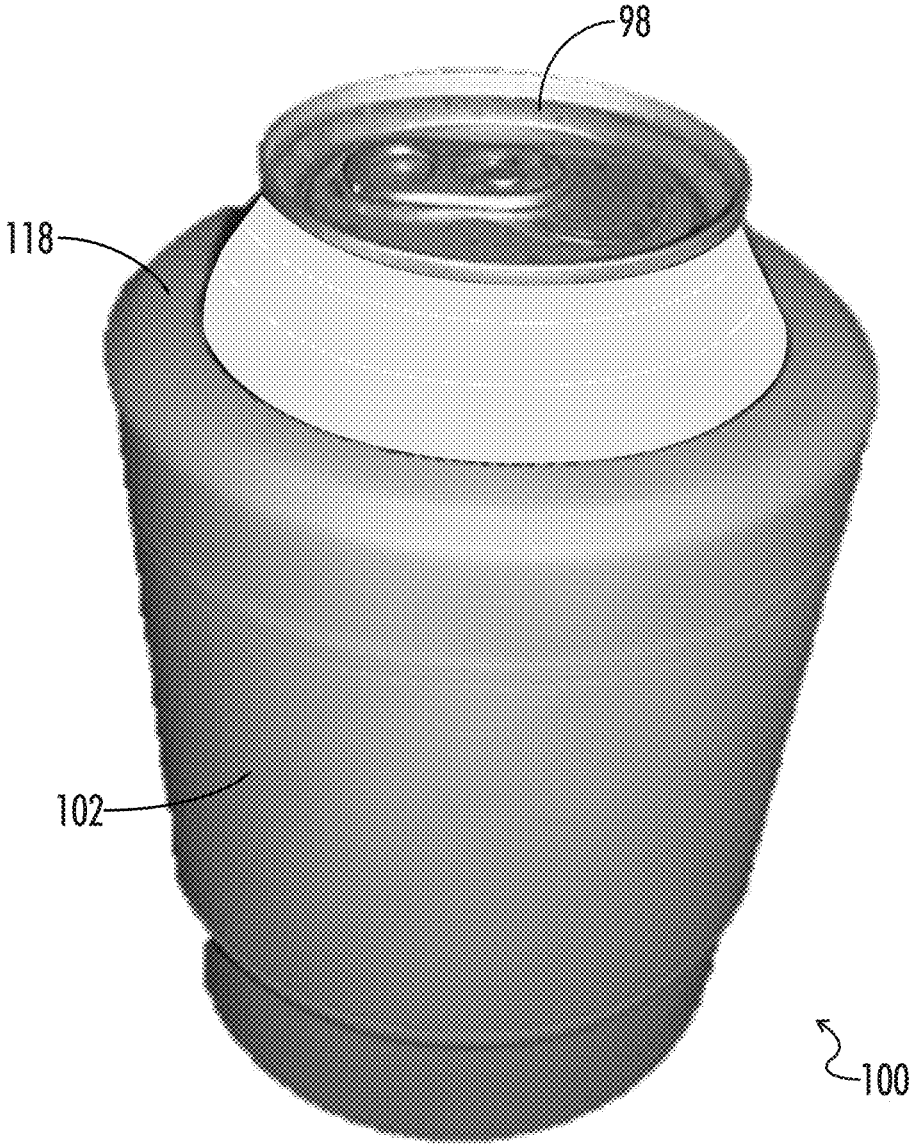
FIG. 5 is an environmental view thereof.

FIGS. 2-5 show an environmental view of one embodiment of the present invention. FIG. 2 shows insertion of the heat transfer unit 116 of device 100 into beverage aperture 103 of housing 102. FIG. 3 shows heat transfer unit 116 inserted into housing 102. FIG. 4 shows a beverage 98 inserted into the aperture 117 of the heat transfer unit 116. Heat transfer unit 116 heats or cools the user's beverage, depending on whether the user has heated or cooled the heat transfer unit 116. FIG. 5 shows the system 100 of one embodiment fully assembled. Threaded lid 118 releasably attaches to housing 102 to secure heat transfer unit 116 within the device. The heat transfer unit 116 then heats or cools the beverage within the beverage container 100.

Figure 6:
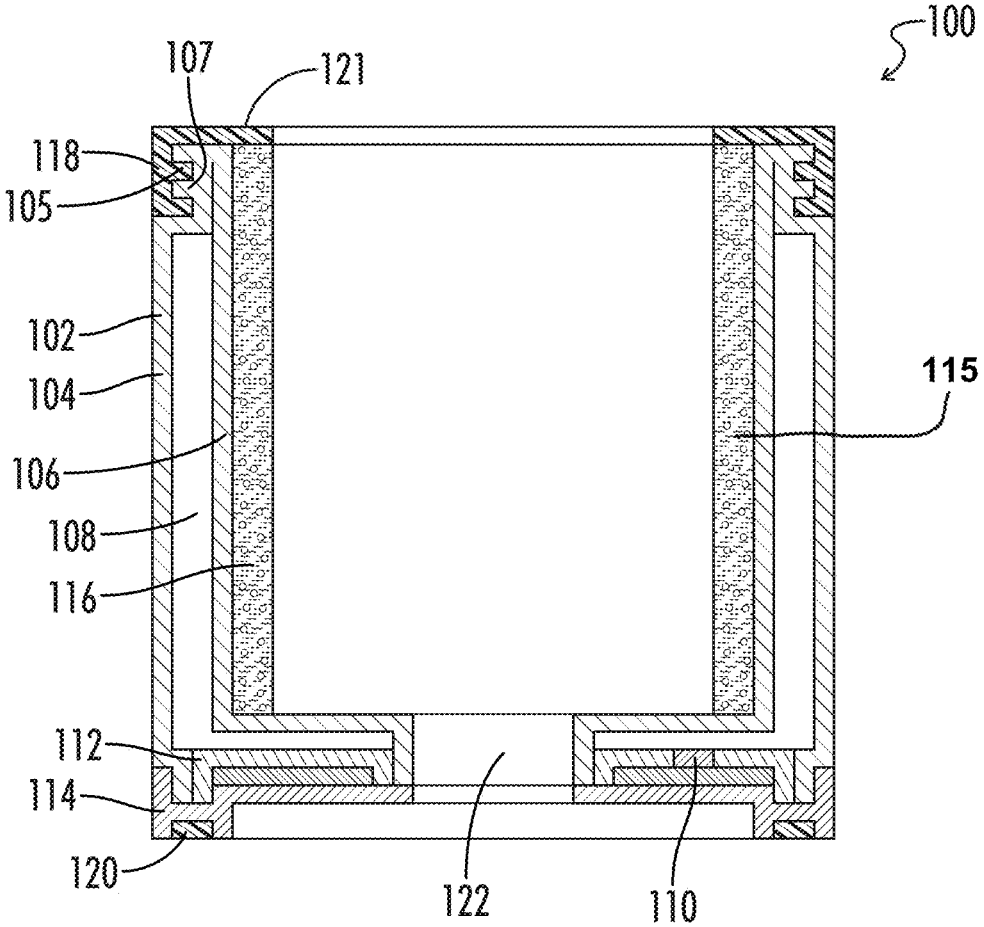
FIG. 6 is a sectional view of one embodiment of the present invention.

FIG. 6 shows a sectional view of the system 100 of one embodiment of the present invention. The housing 102 receives the heat transfer unit 116 in beverage aperture 103. The interior of the housing 102 forms the beverage aperture 103 in which the heat transfer unit 116 installs. The heat transfer unit 116 inserts into the beverage aperture 103.

The heat transfer unit 116 provides beverage aperture 117 for insertion of the beverage. An interior wall of the heat transfer unit forms beverage aperture 117. Beverage aperture 117 is sized to receive a beverage container, such as a can, a bottle, or other vessel.

The housing 102 insulates the heat transfer unit 116 and the beverage 98. Such insulation maintains the temperature of the heat transfer unit 116 and the beverage 98 for an extended period of time. Housing 102 provides insulating chamber 108 laterally outward from the beverage aperture 103 in which the beverage and heat transfer unit 116 inserts.

The outer wall 104 and inner wall 106 of the housing 102 forms insulating chamber 108. The insulating chamber 108 of one embodiment is a vacuum. Another embodiment may provide insulating material or other insulation.

Insulating chamber 108 extends along the sides of the housing 102. The insulating chamber 108 extends to a bottom of the housing 102. Such an insulating chamber 108 insulates the heat transfer unit 116 and the beverage to maintain the temperature of the heat transfer unit 116 and the beverage.

Bottom plate 112 encloses a lower portion of the spacing between outer wall 104 and inner wall 106. The bottom plate 112 is welded to the bottom of outer wall 104 and inner wall 106. Bottom plate 112 creates an air tight space between outer wall 104 and inner wall 106.

Vacuum port 110 in the bottom plate 112 provides an opening for removing air from the insulating chamber 108. Air is removed from the insulating chamber 108 between outer wall 104 and inner wall 106 through vacuum port 110. Creating a vacuum in the insulating chamber 108 forms an insulation layer against the heat transfer unit 116.

Air is removed from insulating chamber 108. Vacuum port 110 is sealed after removal of at least some of the air from insulating chamber 108.

Bottom cap 114 secures to the housing 102. Bottom cap 114 is welded into place. Bottom cap 114 conceals bottom plate 112, the bottom of outer wall 104, the bottom of inner wall 106, and vacuum port 110. The bottom cap 114 is located vertically below a portion of the outer wall 104 and the inner wall 106. The bottom cap 114 contacts a lowest portion of the bottom plate 112 and the outer wall 104. The bottom cap 114 forms an opening 122 for removal of a beverage within the housing 102.

The heat transfer unit 116 removably inserts into the space interior of inner wall 106. A user removes the heat transfer unit 116 to cool or heat the heat transfer unit 116 outside of the housing 102 and the insulating chamber 108.

Heat transfer unit 116 inserts into the housing 102 for heating or cooling the beverage. The lid 118 attaches to the housing 102 to secure the heat transfer unit 116 within the housing 102. The heat transfer unit 116 is positioned adjacent inner wall 106 to contact the beverage and apply a heating or cooling effect to the beverage.

Lid 118 secures the heat transfer unit 116 in the housing 102 adjacent the insulating chamber 116. The lid 118 secures to the housing 102. Retention shoulder 121 extends across and above the heat transfer unit 116 to secure the heat transfer unit 116 within the housing 102. Threads 105 of lid 118 mate with threads 107 of housing 102. The mating of the threads 105, 107 secures the lid 118 to the housing 102.

Lid 118 releasably attaches to housing 102 to maintain the heat transfer unit 116 within housing 102. Lid 118 provides a beverage aperture 119 configured to receive a beverage or a beverage container. The beverage container may be a receptacle for holding a beverage, such as a can, bottle, cup, glass, vessel, or other type of receptacle capable of holding a beverage.

Grip surface 120 attaches to the bottom cap 114. The grip surface 120 frictionally engages a surface upon which the grip surface 120 is placed. In one embodiment, the grip surface 120 is constructed from rubber. The grip surface 120 limits movement of the system 100 and housing 102 across a surface.

Opening 122 is formed by the sides of inner wall 106 and bottom cap 114. Opening 122 allows the user to remove the beverage that is inserted into the beverage container 100.

Figure 7:
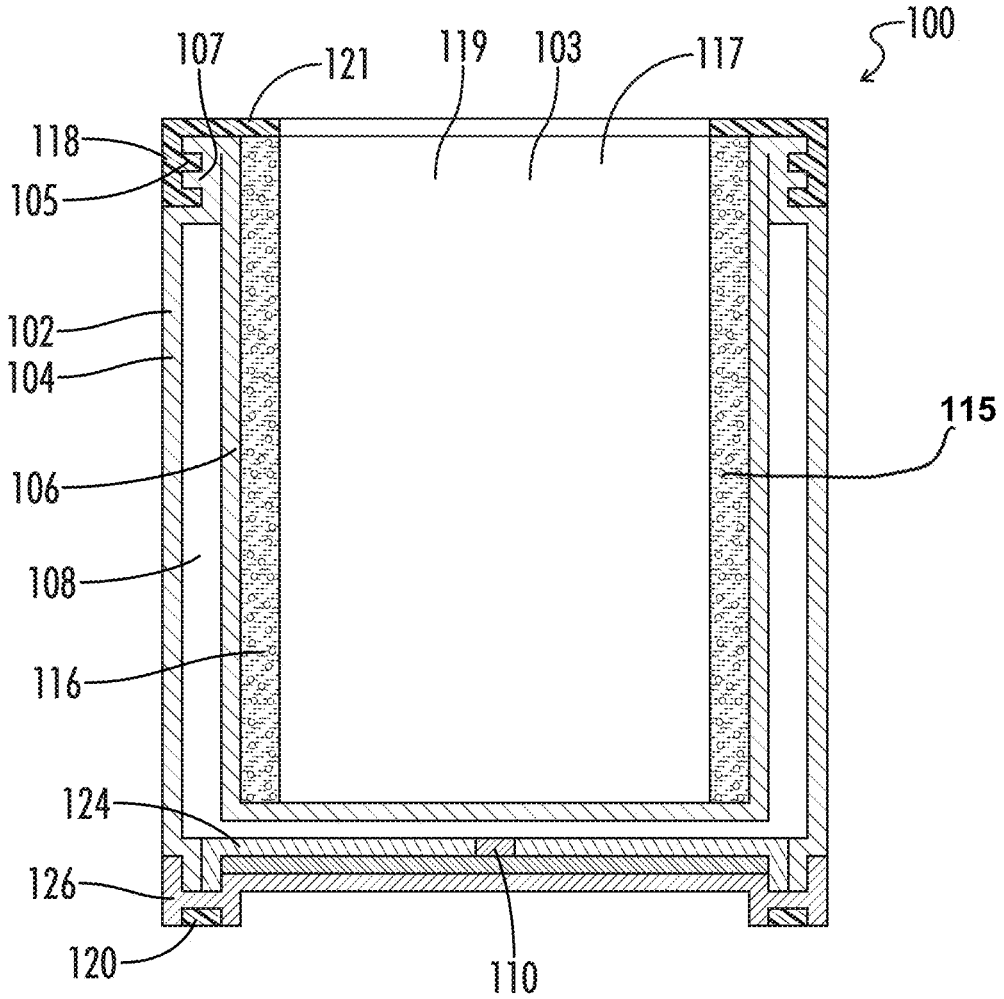
FIG. 7 is a sectional view of one embodiment of the present invention.

FIG. 7 shows another embodiment of the present invention that accepts insertion of a beverage container as described for FIG. 6. This embodiment of beverage system 100 provides insulating chamber 108 within housing 102. Outer wall 104 and inner wall 106 form the insulating chamber 108. The insulating chamber 108 insulates the interior of housing 102.

The lid 118 with retention shoulder 121 secures the heat transfer unit 116 adjacent the insulating chamber 108 and the beverage. Grip surface 120 limits movement of the housing 102 across a surface.

The insulating chamber 108 shown in FIG. 7 extends across the bottom of the housing 102. The bottom plate 124 secures to the outer wall 104. The bottom plate 124 extends from one side of the outer wall 104 to the other side of the outer wall 104 without securing to inner wall 106. The bottom plate 124 is welded to the outer wall 104. As discussed above, the bottom plate 124 provides vacuum port 110 for removing the air from the insulating chamber 108.

The bottom cap 126 secures to the housing 102. The bottom cap 126 secures a lower portion of the outer wall 104 and the bottom plate 124. The bottom cap 126 covers and conceals the vacuum port 110.

Figure 8:
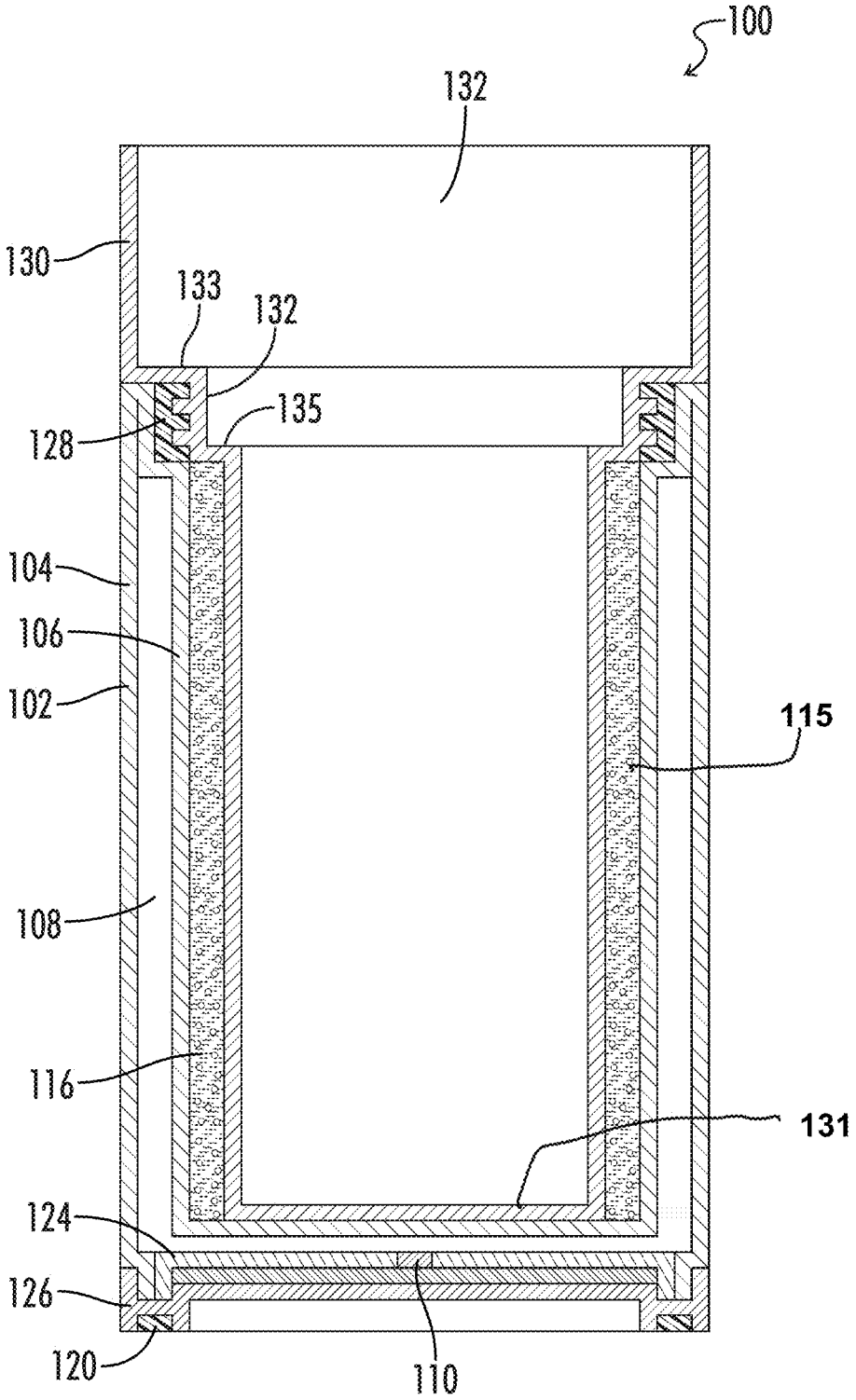
FIG. 8 is a sectional view of one embodiment of the present invention.
Figure 9:
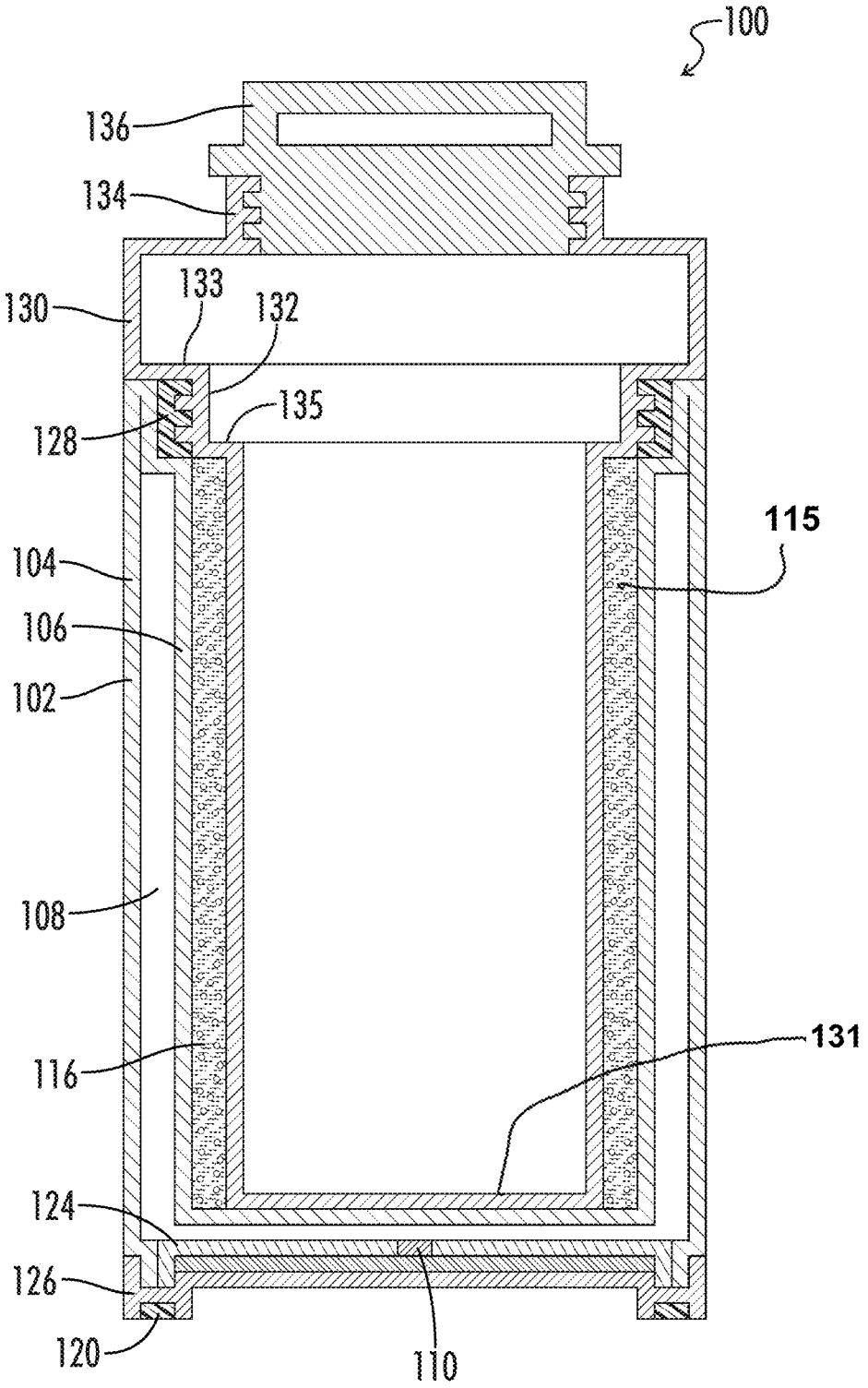
FIG. 9 is a sectional view of one embodiment of the present invention.

FIGS. 8-9 shows another embodiment of the present invention that secures a beverage vessel 130 with an enclosed bottom 131 within the housing 102. Vessel 130 stores a liquid to be consumed by the user. In such an embodiment, vessel 130 serves as a cup. This embodiment of beverage system 100 provides insulating chamber 108 within housing 102. Outer wall 104 and inner wall 106 form the insulating chamber 108. The insulating chamber 108 insulates the interior of housing 102. Grip surface 120 limits movement of the housing 102 across a surface.

The attachment of the vessel 130 with the housing 102 secures the heat transfer unit 116 within the housing 102. As discussed above, the heat transfer unit 116 secures adjacent insulating chamber 108 and the beverage. The heat transfer unit 116 secures adjacent vessel 130 to apply the temperature adjustment to the beverage. Retention shoulder 135 extends from an interior position outward across and above the heat transfer unit 116 to secure the heat transfer unit 116 within the housing 102.

Threads 128 of the housing mate with threads 132 of vessel 130 to secure the vessel 130 with the housing. Threads 128 are secured to the housing 102 in one embodiment. In another embodiment, threads 128 are formed as a part of the housing 102. Upper Shoulder 133 extends from an interior position outward across and above threads 128.

The insulating chamber 108 shown in FIG. 8 extends across the bottom of the housing 102. The bottom plate 124 secures to the outer wall 104. The bottom plate 124 extends from one side of the outer wall 104 to the other side of the outer wall 104 without securing to inner wall 106. The bottom plate 124 is welded to the outer wall 104. As discussed above, the bottom plate 124 provides vacuum port 110 for removing the air from the insulating chamber 108.

The bottom cap 126 secures to the housing 102. The bottom cap 126 secures a lower portion of the outer wall 104 and the bottom plate 124. The bottom cap 126 covers and conceals the vacuum port 110.

FIG. 9 shows another embodiment that provides a vessel 130 secured to the housing 102. The vessel 130 provides a threaded neck 134 that accepts a threaded top 136. Such a top 136 enables sealing of the vessel 130.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An insulated beverage system for receiving a beverage, the system comprising:

a removable transfer housing;

a phase change material sealed within the transfer housing, wherein the phase change material is configured to cool the beverage;

a housing configured to receive the beverage, wherein the housing accepts placement of at least a portion of the transfer housing within the housing, wherein the transfer housing is removable from the housing for cooling the phase change material stored within the transfer housing;

an inner wall of the housing;

an outer wall of the housing secured to the inner wall;

a vacuum sealed chamber formed between the inner wall and the outer wall, wherein the transfer housing installs radially inward from the inner wall, wherein the transfer housing abuts the vacuum sealed chamber, wherein the inner wall is separate from the transfer housing, wherein the transfer housing forms no portion of the vacuum sealed chamber, wherein the vacuum sealed chamber is inseparable from the housing, wherein the transfer housing is separable from the vacuum sealed chamber and the housing for removing the transfer housing from the housing and vacuum sealed chamber to cool the phase change material outside of the vacuum sealed chamber to decrease cooling time required to cool the phase change material stored within the transfer housing;

an opening in the housing wherein the opening extends vertically downward into the housing, the opening receiving the transfer housing, wherein the opening is located radially inward from the vacuum sealed chamber, wherein the opening abuts the vacuum sealed chamber;

a retention shoulder removably attached to the housing at a threaded attachment, the retention shoulder attaching to the housing to secure the transfer housing within the housing, the retention shoulder detaching from the housing for removal and insertion of the transfer housing within the housing, the retention shoulder extending directly vertically above the transfer housing, wherein the retention shoulder extends radially inward from the threaded attachment and an outer edge of the opening, wherein the retention shoulder extends radially inward over the transfer housing and the outer edge of the opening, wherein attachment of the retention shoulder to the housing and the vacuum sealed chamber narrows the opening limits vertical movement of the transfer housing when inserted into the housing.

2. The system of claim 1 wherein the transfer housing is constructed from a rigid material.

3. The system of claim 1, further comprising:

threads secured to the housing located above an uppermost portion of the transfer housing installed within the housing, wherein the retention shoulder attaches to the threads extending from the housing, wherein the threads secured to the housing and the vacuum sealed chamber are located radially outward from the outer edge of the opening.

4. The system of claim 3 further comprising:

threads secured to the retention shoulder, wherein the threads of the retention shoulder mate with the threads of the housing to secure the retention shoulder to the housing;

the threads of the retention shoulder extending radially inward towards the opening, the threads of the housing extending radially outward from the outer wall away from the opening.

5. The system of claim 3, wherein the retention shoulder is secured to a lid, wherein threads of the retention shoulder extend radially outward from the retention shoulder to the inner wall, wherein the threads of the housing extend radially inward from the inner wall towards the opening, wherein the retention shoulder extends radially inward directly above the vacuum sealed chamber and the transfer housing.

6. The system of claim 1, further comprising:

a beverage vessel that releasably attaches to the housing for removing the beverage vessel from the housing, wherein the beverage vessel inserts into the opening, the beverage vessel providing an enclosed bottom for receiving and holding the beverage, wherein the beverage vessel forms the retention shoulder and threads extending radially from the beverage vessel, wherein the threaded attachment secures the beverage vessel to the housing, wherein rotation of the beverage vessel in relation to the housing threads the beverage vessel into the opening to secure the beverage vessel to the housing, wherein the enclosed bottom is located below the threaded attachment within the housing, wherein securing the beverage vessel to the housing positions the retention shoulder vertically above the transfer housing to secure the transfer housing between the beverage vessel and the vacuum sealed chamber.

7. The system of claim 6, wherein the threads of the beverage vessel extend radially outward from the beverage vessel, wherein the enclosed bottom is located below the threads of the beverage vessel, wherein attachment of the beverage vessel with the housing positions the enclosed bottom within the housing, wherein contact between the threads of the beverage vessel and the threads of the housing limit vertical movement of the beverage vessel within the housing, wherein attachment of the beverage vessel to the housing closes the opening;

wherein the threads of the housing extend radially inwards from the inner wall towards the opening, wherein the threads of the housing mate with the threads of the retention shoulder and beverage vessel to secure the beverage vessel to the housing.

8. An insulated beverage system for receiving a beverage, the system comprising:

a transfer housing constructed from a rigid material;

a phase change material sealed within the transfer housing, wherein the phase change material is configured to cool the beverage below an environmental temperature;

a housing configured to receive the beverage, wherein the housing accepts placement of at least a portion of the transfer housing within the housing, wherein the transfer housing is removable from the housing for cooling the phase change material stored within the transfer housing;

an inner wall of the housing, wherein the transfer housing remains detached from the inner wall to allow movement of the transfer housing in relation to the inner wall;

an outer wall of the housing, wherein the outer wall is secured to the inner wall to not allow removal of the inner wall from the outer wall;

a vacuum sealed chamber formed between the inner wall and the outer wall, wherein the transfer housing installs adjacent the inner wall, wherein the vacuum sealed chamber is formed radially inward from the outer wall, wherein the transfer housing abuts the vacuum sealed chamber, wherein the inner wall seals with the outer wall to maintain the vacuum sealed chamber, wherein the transfer housing forms no portion of the vacuum sealed chamber, wherein the vacuum sealed chamber is inseparable from the housing, wherein the transfer housing is separable from the vacuum sealed chamber and the housing for removing the transfer housing from the housing and the vacuum sealed chamber without opening the vacuum sealed chamber, wherein the transfer housing is removable from the housing and the vacuum sealed chamber for cooling the phase change material outside of the vacuum sealed chamber to cool the phase change material stored within the transfer housing below the environmental temperature;

an opening in the housing wherein the opening extends vertically downward into the housing, the opening receiving the transfer housing, the vacuum sealed chamber located adjacent and radially outward from the opening, wherein the opening abuts the vacuum sealed chamber;

a retention shoulder removably attached to the housing at a threaded attachment, the retention shoulder attaching to the housing to secure the transfer housing within the housing, the retention shoulder detaching from the housing for removal and insertion of the transfer housing within the housing, the retention shoulder extending radially inward from the threaded attachment of the retention shoulder at the inner wall, wherein the retention shoulder extends vertically above the transfer housing to limit vertical movement of the transfer housing;

wherein the threaded attachment is located radially outward from the opening, wherein the retention shoulder extends radially inward from the threaded attachment over the opening, wherein attachment of the retention shoulder to the housing limits vertical movement of the transfer housing within the opening.

9. The system of claim 8, further comprising:

threads secured to the housing and the vacuum sealed chamber located above an uppermost portion of the transfer housing installed within the housing, wherein the threads of the housing extend radially from the housing vertically above the vacuum sealed chamber, wherein the retention shoulder attaches to the threads secured to the housing, wherein the threads of the housing are located radially outward from the opening; and threads secured to the retention shoulder wherein the threads of the retention shoulder mate with the threads of the housing to secure the retention shoulder to the housing.

10. The system of claim 8, further comprising:

a beverage vessel that releasably attaches to the housing for removing the beverage vessel from the housing, the beverage vessel providing an enclosed bottom for receiving and holding the beverage, wherein the beverage vessel forms the retention shoulder;

threads of the beverage vessel extending radially outward from the beverage vessel, wherein the retention shoulder and enclosed bottom are located vertically below the threads of the beverage vessel, wherein securing the beverage vessel to the housing positions the retention shoulder vertically above the transfer housing to secure the transfer housing between the beverage vessel and the vacuum sealed chamber; and threads secured to the housing and the vacuum sealed chamber located radially outward from the opening, wherein the threads of the housing are located vertically above the vacuum sealed chamber, wherein the beverage vessel attaches to the threads secured to the housing.

11. The system of claim 10, wherein the threads of the housing extend radially inwards towards the opening, wherein the threads of the housing mate with the threads of the beverage vessel to secure the beverage vessel to the housing, wherein the threads of the housing are positioned not to narrow the opening;

wherein attachment of the beverage vessel to the housing encloses the transfer housing within the opening.

12. The system of claim 8, wherein the opening extends vertically from a top of the housing through a bottom of the housing;

wherein the opening extends through the vacuum sealed chamber located at the bottom of the housing, wherein the opening passes through the inner wall and the outer wall through the bottom of the housing;

wherein the vacuum sealed chamber extends radially inward at the bottom of the housing to form the vacuum around the opening through the bottom of the housing.

13. The system of claim 8, wherein the retention shoulder is secured to a lid, wherein the retention shoulder extends radially inward directly above the vacuum sealed chamber and the transfer housing.

14. An insulated beverage system for receiving a beverage, the system comprising:

a transfer housing constructed from a rigid material, wherein the transfer housing has an opening in a top of the transfer housing that extends through a bottom of the transfer housing;

a phase change material sealed within the transfer housing, wherein the phase change material is configured to cool the beverage below an environmental temperature at which the beverage is consumed;

a housing configured to receive the beverage, wherein the housing accepts placement of at least a portion of the transfer housing within the housing, wherein the transfer housing is removable from the housing;

an inner wall of the housing, wherein the transfer housing remains detached from the inner wall to allow movement of the transfer housing in relation to the inner wall;

an outer wall of the housing, wherein the outer wall is secured to the inner wall to not allow removal of the inner wall from the outer wall;

a vacuum sealed chamber formed between the inner wall and the outer wall, wherein the vacuum sealed chamber is formed radially inward from the outer wall and interior of the housing, wherein the transfer housing installs adjacent the vacuum sealed chamber and the inner wall, wherein the transfer housing installed within the housing abuts the vacuum sealed chamber wherein the inner wall seals with the outer wall to maintain the vacuum sealed chamber, wherein the vacuum sealed chamber is inseparable from the housing, wherein the transfer housing is separable from the vacuum sealed chamber and the housing for removing the transfer housing from the housing and the vacuum sealed chamber without opening the vacuum sealed chamber, wherein the housing is secured to the vacuum sealed chamber, wherein the transfer housing is removable from the housing and the vacuum sealed chamber for cooling the phase change material outside of the vacuum sealed chamber below the environment, wherein removal of the transfer housing from the vacuum sealed chamber eliminates coverage of the transfer housing by the vacuum sealed chamber for cooling the phase change material stored within the transfer housing below the environmental temperature without insulation from the vacuum sealed chamber;

an opening in the housing wherein the opening extends vertically downward into the housing, the opening receiving the transfer housing, the vacuum sealed chamber located adjacent and radially outward from the opening;

a retention shoulder removably attached to the housing, the retention shoulder attaching to the housing to secure the transfer housing within the housing, the retention shoulder detaching from the housing for removal and insertion of the transfer housing within the housing, the retention shoulder extending radially inward from a threaded attachment of the retention shoulder to the inner wall, the retention shoulder extending radially inward directly above the vacuum sealed chamber and the transfer housing to limit vertical movement of the transfer housing;

threads secured to the housing and the vacuum sealed chamber located above the uppermost portion of the transfer housing installed within the housing, wherein the threads extend from the housing vertically above the vacuum sealed chamber; and threads secured to the retention shoulder wherein the threads of the retention shoulder mate with the threads of the housing for a threaded attachment of the retention shoulder with the housing;

an opening in the housing wherein the opening extends vertically downward into the housing, wherein the transfer housing is placed within the opening, wherein the opening is located radially inward from the vacuum sealed chamber, wherein the opening abuts the vacuum sealed chamber;

wherein the threads extending radially from the housing are located radially outward from the opening;

wherein attachment of the retention shoulder narrows the opening, wherein the retention shoulder extends radially inward past an outer edge of the opening.

15. The system of claim 14, further comprising:

a beverage vessel that releasably attaches to the housing for removing the beverage vessel from the housing, the beverage vessel providing an enclosed bottom for receiving and holding the beverage, wherein the beverage vessel forms the retention shoulder and the threads extending radially from the housing, wherein the threaded attachment frictionally engages the beverage vessel with the housing, wherein the enclosed bottom is located below the retention shoulder and the threaded attachment of the beverage vessel, wherein securing the beverage vessel to the housing positions the retention shoulder vertically above the transfer housing to secure the transfer housing between the beverage vessel and the vacuum sealed chamber;

wherein rotation of the beverage vessel in relation to the housing threads the beverage vessel into the housing to secure the beverage vessel to the housing within the opening to abut the transfer housing.

16. The system of claim 15, wherein the threads of the retention shoulder extend radially outward from the beverage vessel;

wherein the threads of the housing extend radially inwards from the inner wall towards the opening, wherein the threads of the housing mate with the threads of the retention shoulder and beverage vessel to secure the beverage vessel to the housing.

17. The system of claim 14, wherein the opening extends vertically from a top of the housing through a bottom of the housing.

18. The system of claim 17, wherein the opening extends through the vacuum sealed chamber located at the bottom of the housing, wherein the opening passes through the inner wall and the outer wall through the bottom of the housing.

19. The system of claim 18, wherein the vacuum sealed chamber extends radially inward at the bottom of the housing to form the vacuum around the opening through the bottom of the housing.

* * * * *